United States Patent [19]

Houchangnia

[11] Patent Number: 4,695,844

[45] Date of Patent: Sep. 22, 1987

[54] DEVICE FOR RECEIVING DUAL POLARIZED MICROWAVE SIGNALS

[75] Inventor: Zavoche Houchangnia, Angers, France

[73] Assignee: Societe D'Electronique de La Region Pays de Loire, Paris, France

[21] Appl. No.: 770,951

[22] Filed: Aug. 30, 1985

[30] Foreign Application Priority Data

Aug. 31, 1984 [FR] France ..... 84 13509

[51] Int. Cl.[4] ..... H01Q 1/38; H01Q 19/17

[52] U.S. Cl. ..... 343/781 CA; 343/786; 333/21 A

[58] Field of Search ..... 343/786, 756, 846, 772, 343/781 P, 789, 795, 840, 700 MS, 834–837, 781 CA; 333/248, 250, 254, 21 A, 137

[56] References Cited

U.S. PATENT DOCUMENTS

| | | | |
|---|---|---|---|
| 2,682,610 | 6/1954 | King et al. | 343/786 |
| 4,529,898 | 7/1985 | Dupressoir et al. | 343/756 |

FOREIGN PATENT DOCUMENTS

| | | | |
|---|---|---|---|
| 0073511 | 3/1983 | European Pat. Off. . | |
| 0089084 | 9/1983 | European Pat. Off. . | |
| 0108463 | 5/1984 | European Pat. Off. . | |
| 0123350 | 10/1984 | European Pat. Off. | 343/700 MS |

OTHER PUBLICATIONS

IRE Transactions on Microwave Theory and Techniques, vol. MTT-4, No. 3, Jul. '56, Tomkins, "A Broad-Band Dual-Mode Circular Waveguide Transducer", pp. 181–183.

*Primary Examiner*—William L. Sikes
*Assistant Examiner*—Michael C. Wimer
*Attorney, Agent, or Firm*—Oblon, Fisher, Spivak, McClelland & Maier

[57] ABSTRACT

A device for receiving dual polarized microwave signals, including a first waveguide connected to a receiving antenna and to a first substrate bearing a first sensor perpendicular to the longitudinal axis of the first waveguide, a second waveguide having the same longitudinal axis and the same dimensions as the first waveguide, and which is connected to a second substrate having a second sensor perpendicular to the longitudinal axis of the second waveguide. Surrounding the second waveguide is a tube having tongues at opposed ends which cooperate with slots formed in the first and second substrates. The opposed tongues of the tube are staggered by 90° so that upon insertion of the opposed tongues of the tube within the slots of the first and second substrates, sensors formed on these substrates are arranged orthogonally with respect to one another. The tongues and cooperating slots assure mechanical integrity. A metallic blade is mounted in axially extending diametrically opposed slots formed in the second waveguide in the tube to maximize decoupling between the dual polarized signals being received.

12 Claims, 5 Drawing Figures

DEVICE FOR RECEIVING DUAL POLARIZED MICROWAVE SIGNALS

BACKGROUND OF THE INVENTION

1. Field of the Invention

The invention concerns a device for receiving dual polarized microwave signals, constituted by simple elements that allow rapid and easy assembly without the need for subsequent adjustment, and which confer upon said assembly sufficient strength.

This device is more particularly intended for receiving dual polarized microwave signals emitted for television receiver sets, for example, from geostationary satellites. It is intended to be utilized in receiving stations, associated to the active elements equipping the microwave heads of said stations.

More generally, the device can be utilized for receiving all dual polarized microwave signals, by adapting certain of its elements to the frequency range to which it is intended.

A signal, or a wave, is called a dual polarized signal, or wave, when it is not propagated on one plane, as in the case of a rectilinear biased signal (called a plane wave), but about an axis determining the direction of propagation of the signal. This is the case with circular polarized waves, or elliptical polarized waves.

A dual polarized wave can be considered as being two superimposed rectiliner polarized waves.

The polarization is circular when the amplitude of the field vector (electric or magnetic) resulting from superimposing of the two waves is constant about the axis of propagation; more specifically, the end of the field vector forms a circle about the axis, when projected on a plane perpendicular to this axis.

A circular polarized wave results from two plane waves, that are orthogonal between each other, and the maximum amplitudes of which, as well as the frequencies, are equal, but between which a phase shift of 90° exists.

The polarization is elliptical when the amplitude of the field vector varies around the axis of propagation. Its end forms an ellipse, when projected along a plane perpendicular to the axis.

An elliptically polarized wave results from two plane, orthogonal waves, the maximum amplitudes of which are different.

The circular polarization is principally utilized in satellite tracking stations or in space communications installations. The consequences of the Faraday effect that exists in the ionosphere are thus reduced, and reception is improved. Circular polarization is also utilized in ground-based radar systems, in order to limit the noise echoes due to clouds.

2. Prior Art

In order to exploit upon reception a wave emitted in with dual polarization, it is known to break up this wave into two plane waves, then to analyse each of the components obtained.

This means that a device for receiving dual polarized microwave signals or waves must comprise means for ensuring the reception and processing of two rectilinear polarized microwave signals.

In known devices for receiving rectilinear polarized microwave signals, the signal is picked up by using a probe or sensor that supplies the input of a microwave head.

The microwave heads comprise a pre-amplifier stage connected to the sensor, in order to amplify the signal received in the band of centimetric waves. A heterodyne converter, constituted by a local oscillator and a mixer, allows to transpose the frequency of the signal received by the sensor towards a lower frequency, for example in the band of decimetric waves; thereafter, an amplifier acts upon the transposed signal prior to its exploitation.

These various components comprise microstrip or stripline elements distributed on dielectric substrates having a thickness more or less important, depending upon whether they are associated to the decimetric waves circuit or to the centimetric waves circuit. Conductor sections are achieved through metallization on these substrates and their width varies according to the frequency band to which they are intended.

The sensor to pick up the signal is, in these different circuits, formed through using a metallization placed upon one of the substrates, and is positioned inside a waveguide connected to the receiving antenna.

The realization of a device for receiving dual polarized microwave signals presents drawbacks since this device should be equipped with two sensors and two substrate assemblies.

It is first of all necessary that the sensors be disposed so as to receive signals that are orthogonal to one another. It is thereafter necessary that the circuits supplying the microwave heads do not interfere; it is also necessary that assembly be rapid, and requires no subsequent adjustments, while presenting sufficient stiffness.

SUMMARY OF THE INVENTION

The device according to the invention fulfills these various conditions.

According to the invention, a device for receiving a dual polarized microwave signal comprises an antenna in order to direct the signal towards a wave guide at the input of which is placed a depolarization converter that allows to break up the signal into two orthogonal, rectilinear polarized components, and wherein a sensor realized through metallization of a first dielectric substrate is placed inside the wave guide, adjacent to the output, perpendicularly to the longitudinal axis of this guide, and is maintained at a distance from a second sensor, realized through metallization of a second dielectric substrate, that is placed perpendicularly to the longitudinal axis of the guide, adjacent to one end of a second wave guide having the same internal section as the first one, and which is placed in the extension of this former guide, and wherein means allow to ensure the orthogonality of the two sensors with respect to the axis and with respect to each other already upon mounting of the assembly, and wherein means are provided to ensure the decoupling and the accommodation of the sensors without subsequent adjustment being necessary.

In a preferred embodiment of the device according to the invention, the two sensors are maintained apart from each other through the second wave guide, at the ends of which are placed the substrates bearing each sensor, and the orthogonality between the two sensors is secured due to a tube into which is fitted the wave guide, and at the ends of which are positioned identical tongues from one end of the tube to the other, but staggerd by 90°, foreseen in order to cooperate with slots provided in the substrates, and positioned on one substrate and on the other at the same relative sites with respect to the sensors.

BRIEF DESCRIPTION OF THE DRAWINGS

Other objects, advantages and features of the invention will become apparent from reading the following description of several embodiments of the device, given with reference to the appended drawing in which.

DESCRIPTION OF THE PREFERRED EMBODIMENTS

Figure 1:
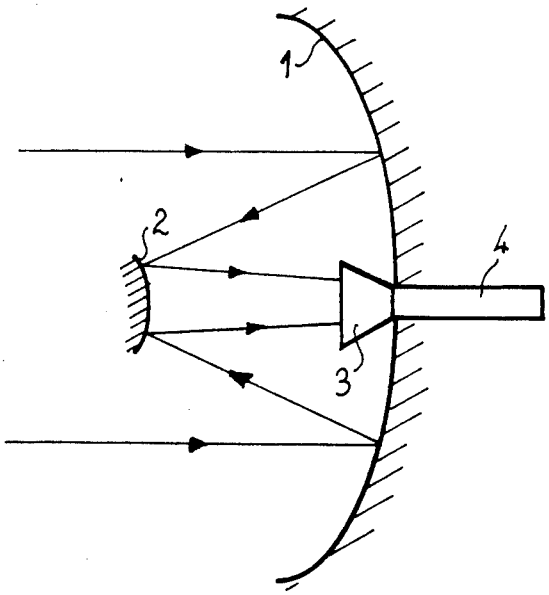
FIG. 1 shows an antenna or aerial that can be utilized in association with the device according to the invention.

The device for receiving dual polarized waves comprises, as shown in FIG. 1, a Cassegrain-type receiving antenna or aerial constituted by a paraboidal reflector 1, at the focal point of which is positioned a hyperboloidal reflector 2 that sends back or returns the electromagnetic waves towards a receiving horn 3 associated to a wave guide 4 the purpose of which is to direct the waves towards the active elements of the high-frequency circuits that are positioned at the end of the wave guides facing the antenna.

The depolarization of the circular polarized wave into two plane waves is carried out, in a manner known per se, by using a depolarization converter located at the output of the receiving horn 3, in the wave guide 4. This converter, not represented in the figures, is made of a dielectric or a metallic blade.

Figure 2:
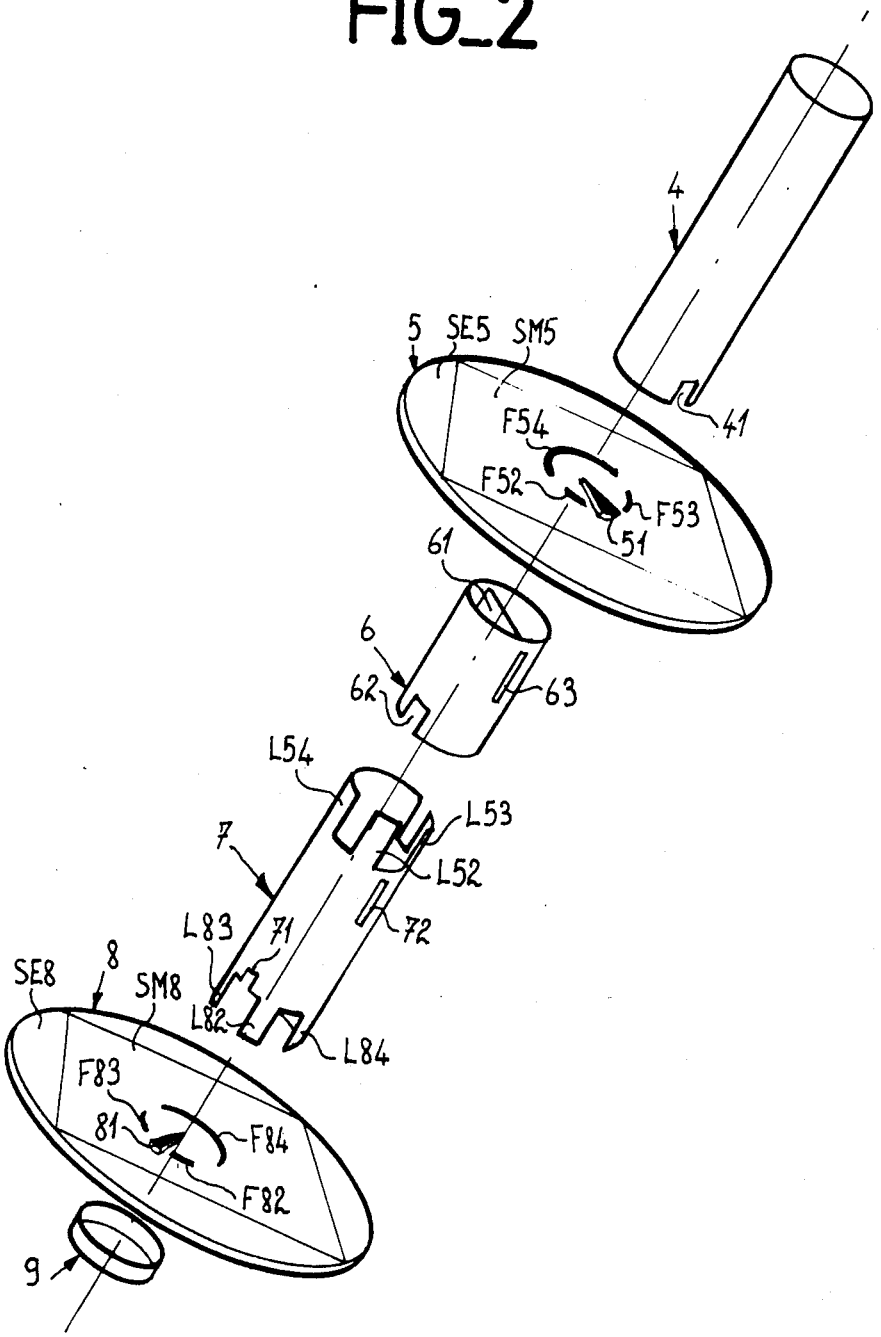
FIG. 2 is an exploded view of the device according to the invention, allowing to show its constitutive elements.

The two waves thus obtained are orthogonal to each other and continue their propagation inside the wave guide 4. The device represented in FIG. 2 shows, in an exploded view, the constitutive elements allowing the reception of these two orthogonal waves.

The wave guide 4 has the form of a cylinder open at both ends. One of the ends is connected to the outlet of the receiving horn 3 represented in FIG. 1. At the other end, intended to be adjacent to the receiving circuits, a recess 41 is provided for the passage of the electrical connection between one sensor 51 and the microwave head (not represented) to which it is associated.

The device also comprises a first microwave assembly 5 on which is located the first sensor 51 for receiving one of the two waves issuing from the breaking up of the dual polarized signal by the depolarization converter.

In a preferred embodiment of the invention, this assembly is mounted according to the technology taught by French patent published under No. 2 522 885 in the name of the applicant.

It is constituted by two superimposed substrates: a thin substrate SM 5 intended for the band of centimetric waves and a thick substrate SE 5 intended for the band of decimetric waves.

The sensor 51 intended for the reception is realized by a metallization of the face of the thin substrate SM 5 not facing the thick substrate SE 5.

This sensor 51 possesses a quasi triangular form (axial section of a "cone") the apex of which is located substantially at the centre of a circle, delimited on the assembly of substrates by slots $F_{52}$, $F_{53}$, $F_{54}$ in the form of arcs. These slots cross through the two substrates SM 5 and SE 5 on either side. A metallization schematically indicated by reference numeral designaton 13 is located between the two substrates and acts as a groundplane.

The thin substrate SM 5 is intended to be located opposite the end of the wave guide 4 that bears recess 41.

A cylindrical guide 6 the internal diameter of which is identical to that of the internal diameter of the guide 4 is intended to be placed, by one of its ends, opposite the thick substrate SE 5. Adjacent to this end, in the wall of the guide, are provided two thin slots, that are diametrically opposite each other and parallel to the longitudinal axis of the guide. Only one of these slots 63 can be seen on the figure. These slots are intended to receive a metallic blade 61 for adapting the sensor 51 and the decoupling between the two accesses as will be explained herein-above.

At the other end of this guide is located a recess 62 that allows the passage of the second sensor (for receiving the second signal).

This guide 6 also possesses the same external diameter as the guide 4 connected to the horn. A tube 7 is provided with an internal diameter equal to the external diameter of the guide 6, in order that this latter may be fitted inside the tube.

The end of the tube 7 intended to be positioned opposite the thick substrate of the assembly 5 has protrusions in the form of tongues $L_{52}$, $L_{53}$, $L_{54}$ complementary to the slots $F_{52}$, $F_{53}$, $L_{54}$ that cross through the two substrates SM 5 and SE 5, in order that these tongues may be engaged within the slots, and that the tube 7 be rendered integral with the assembly 5.

The other end of the tube 7 also ends with tongues $L_{82}$, $L_{83}$, $L_{84}$ identical to those of the other end, but staggered by 90° with respect to these latter tongues.

The length of the tube 7, without tongues of each end is equal to the length of the guide 6. A recess 71 is provided between two tongues $L_{82}$ and $L_{83}$, in order to be opposite the recess 62 of the guide 6 when it is in position, in order to allow the passage of an electrical connection between a second sensor and a high-frequency head.

Two slots, only one of which 72 can be seen on the figure, are provided in the wall of the tube 7, parallel to its longitudinal axis in order to allow the positioning of the metallic blade 61 in the slots 63 of the guide 6.

The slots 63 of the guide 6 and 72 of the tube 7 are positioned so that the blade 61 for adapting the sensor 51 is parallel to the longitudinal axis of this sensor when the tongues $L_{52}$, $L_{53}$, $L_{54}$ of the tube are in position in the slots $F_{52}$, $F_{53}$, $F_{54}$ of the assembly 5 carrying this sensor 51.

The tongues of the tube 7 and the corresponding slots of the assembly 5 are disposed so that a single positioning of this assembly is possible.

A second assembly 8 comprising microwave elements is identical to the first one and comprises a sensor 81 and three slots $F_{82}$, $F_{83}$, $F_{84}$ intended to cooperate with the tongues $L_{82}$, $L_{83}$, $L_{84}$ of the other end of the tube 8.

The guide transition acting as sensor 81 is realized by using a quasi-triangular metallization provided on the thin substrate SM 8 of the second assembly 8. This sensor is connected to the amplifier stage of the high-frequency head by a microwave connection passing through the recesses 71 of the tube 7 and 62 of the guide 6.

A thick substrate SE 8 also comprises this microwave assembly 8 according to the technology described in French patent published under No. 2 522 885 already cited herein-above.

The slots $F_{82}$, $F_{83}$, $F_{84}$ are provided in the thickness of the two substrates, identical to the slots $F_{52}$, $F_{53}$, $F_{54}$ of the first assembly of circuits, and are intended to cooperate with the tongues $L_{82}$, $L_{83}$, $L_{84}$ of the tube 7.

A cylindrical cup 9, sealed by a short-circuit bottom, possesses an internal diameter equal to the internal diameter of the guide 6 and an external diameter equal to the internal diameter of the tube 7. This cup is provided in order to be fitted into the tongues $L_{82}$, $L_{83}$, $L_{84}$ when the tube 7 is positioned on the assembly 8 of the microwave circuits.

Figure 3:
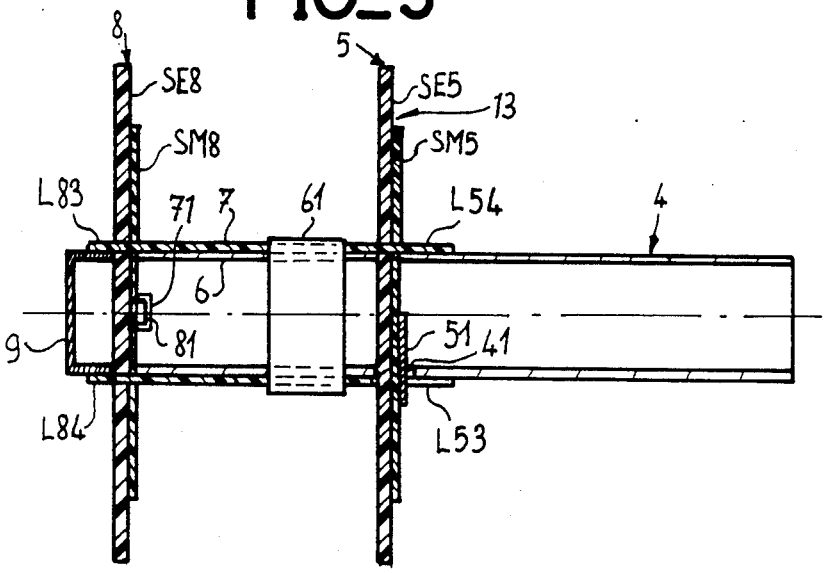
FIG. 3 is a cross sectional view of the device according to the invention once it has been assembled.
Figure 4:
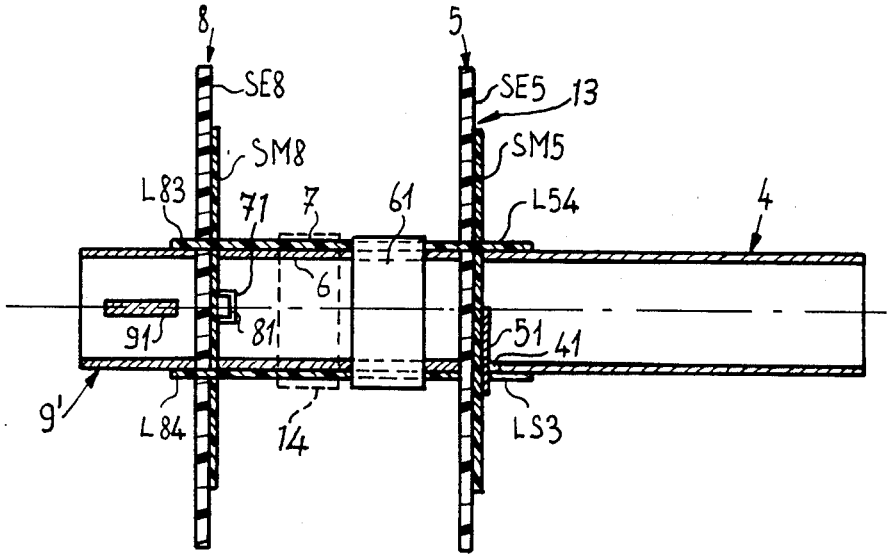
FIG. 4 is a cross sectional view of a variant of the device according to the invention once it has been assembled.

FIGS. 3 and 4 show, according to a section crossing through the longituidnal axis of the sensor 51, the device when the constitutive elements are in position.

The wave guide 4 intended to be connected to the antenna is in contact with the thin substrate SM 5 of the first assembly 5 of microwave circuits. The recess 41 allows the passage of the sensor 51 and its electrical connection with the microwave head to which it is associated. The second guide 6 is positioned between the two assemblies 5 and 8 of microwave circuits. Its presence allows that substrates SM 5, SE 5, SM 8, SE 8 and consequently sensors 51 and 81 that it bears be respectively on perfectly parallel planes, while remaining perpendicular to the longitudinal axis of the guides. This is rendered possible since the ends of the guides are in straight sections. The tube 7, due to tongues engaged within the slots of assemblies 5 and 8 of microwave circuits allows that the sensors be orthogonal to each other, since the tongues are similar from one end to the other but staggered by 90° and since the assemblies 5 and 8 of the microwave circuits are identical, and have in particular their slots positioned at the same sites with respect to the sensors.

The stiff securing of the wave guide 4 with respect to the first assembly 5 of microwave circuit is ensured due to tongues $L_{52}$ $L_{53}$ $L_{54}$ as represented in FIGS. 3 and 4.

The metallic blade 61 is welded, after having been positioned in both the slots 63 and 72 of the guide 6 and of the tube 7. It is placed parallel to the longitudinal axis of the sensor 51 and thus reflects all the waves that are parallel thereto. Due to this fact, the sensor 51 is adapted.

The distance separating the two sensors is equal to a guided wavelength. In order that the adaptation of the wave be effective, it is necessary that the middle of the metallic blade 61 be situated at a distance from the sensor 51 equal to one quarter of the guided wavelength. Thereby, this metallic blade returns towards the sensor 51 the component of the field that is parallel thereto, thereby allowing adaptation of the sensor 51 and establishment of a good decoupling between the two accesses.

The termination cup 9 is held on the assembly in a manner similar to the wave guide 4; the tongues $L_{82}$ $L_{83}$ $L_{84}$ crossing through the slots of the second assembly 8 of circuits allow its holding. The bottom of this cup is maintained parallel to the assembly 8 of circuits, at a distance from the sensor 81 slightly smaller than one quarter of the length of the guided wave. This short-circuit bottom allows the adaptation of the second sensor 81.

It is possible to improve the decoupling by replacing the cup 9 by a metallic blade 91 parallel to the longitudinal axis of the sensor 81, as represented in FIG. 4. This blade is secured within a circular guide 9' having the same internal and external diameters as the guides 4 and 6.

This metallic blade 91 is held within the guide 9' due to slots that are diametrically opposed and parallel to the longitudinal axis of this guide, as was the case for the metallic blade 61 of the guide 6 and the tube 8.

The decoupling can also be improved by placing a resistive blade schematically shown in FIG. 4 by dashed lines and referenced by numeral 14 between the metallic blade 61 and the second sensor 81 parallel to the blade 61.

This blade 14 will absorb the remainder of the field component parallel to the first sensor 51 that will not have been reflected by the metallic blade 61 and which will not have been picked up by the first sensor 51.

The utilization of this blade is absolutely necessary when the decoupling between the two accesses must be higher than the values required by the criteria for receiving television broadcasts by satellite.

Figure 5:
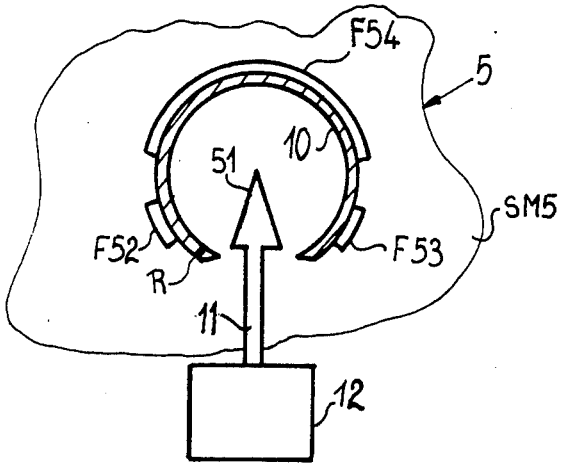
FIG. 5 represents in detail one of the portions of the device according to the invention.

FIG. 5 represents a partial view, from the side of the thin substrate SM 5, of the first assembly 5 of the microwave circuits. The second assembly 8 of microwave circuits also possesses the structure represented in FIG. 5.

Slots $F_{52}$, $F_{53}$, $F_{54}$ intended to cooperate with the tongues of tube 7 are apparent in this figure. An annular metallization 10 possesses an external diameter equal to the internal diameter of the slots and an internal diameter equal to that of the waveguide 4. This metallization is provided on the thin substrate SM 5 and is connected by a ground transfer rivet R to the groundplane 13 that, it will be recalled, is situated between the two substrates SM 5 and SE 5.

The sensor 51 is connected through the intermediary of a microwave connection 11 to the remainder of the circuits comprising the microwave head 12.

This metallization allows, when the device has been completely assembled, the waveguide 4 to be connected to ground.

A similar metallization on the thin substrate SM 8 of the second assembly of microwave circuits allows the contact of the waveguide 6 situated between the two microwave circuit assemblies with the ground plane comprised between the thin substrate SM 8 and thick substrate SE 8 of the second assembly of circuits.

It is preferable that the electrical contact with ground is ensured by realizing a welding band between the guide 4 and the metallization 10 of the first assembly of circuits or between the guide 6 and the corresponding metallization of the second assembly of circuits.

It is also preferable, in order to ensure a good mechanical strength of the assembly that welding spots be ensured between the waveguide 4 and the tongues $L_{52}$, $L_{53}$, $L_{54}$ and between the cup 9 or the guide 9 bis and the tongues $L_{82}$, $L_{83}$, $L_{84}$ of the tube 7.

I claim:

1. Device for receiving a dual polarized microwave signal from an antenna and a depolarization converter electrically coupled to said antenna, said converter coupled to an input of said device and provided to separate the dual polarized microwave signal into two rectilinear polarized components, comprising:

a first waveguide having an input coupled to said converter and an output, said first waveguide having predetermined dimensions and defining a longitudinal axis;

a first sensor comprising a first dielectric substrate and a first metallization formed on said first dielectric substrate, said substrate arranged perpendicular to said longitudinal axis, said first metallization located under said first waveguide adjacent the output of said first waveguide, said first dielectric substrate having at least one slot arranged with a predetermined orientation relative to said first metallization;

a second waveguide defining a longitudinal axis the same as that of said first waveguide and having an input, an output, and internal dimensions the same as that of said first waveguide, said input of said second waveguide arranged adjacent a side of said first dielectric substrate opposite the first waveguide;

a second sensor comprising a second dielectric substrate and a second metallization formed on said second dielectric substrate, said second substrate arranged perpendicular to said longitudinal axis at the output of said second waveguide, said second dielectric substrate having at least one slot arranged with a predetermined orientation relative to said second metallization;

a tube for mechanically coupling said first and second substrates and said second waveguide such that said first and second metallizations provided on said first and second substrates are orthogonal, said tube having an internal dimension equal to the external dimensions of said second waveguide and opposite ends each having at least one protruding tongue, said tube surrounding said second waveguide with said tongues protruding through and mating with the slots of said first and second substrates so that the predetermined orientations of said slots produce orthogonality between said first and second metallizations; and means provided attached to said tube and said second waveguide for decoupling said sensors.

2. Device according to claim 1, wherein said tube comprises plural tongues at each end, wherein the tongues at one end of the tube are staggered by 90° with respect to the tongues at the other end of the tube, and wherein said substrates comprise complementary slots which in each substrate have the same relative positions with respect to the respective first and second metallizations, such that when the tongues at respective ends of the tube are engaged within respective slots formed in the respective first and second substrates, orthogonality between the two sensors is assured.

3. Device according to claims 1 or 2, wherein said first and second waveguides each have a circular cross-section.

4. A device according to claim 3, comprising:

said tube and said second waveguide each having diametrically opposed axially extending slots formed in the walls thereof; and a metallic blade placed within the diameterically opposed axially extending slots of the second waveguide and the tube, said blade being perpendicular to said longitudinal axis and parallel to said first sensor.

5. Device according to claim 4, wherein the metallic blade has a middle placed at a distance of one-quarter wavelength of the waveguide from the first sensor such that a component of electric field that is parallel to said waveguide is returned toward said first sensor.

6. Device according to claim 5, further comprising:

a resistive blade placed between the second sensor and said metallic blade parallel to said metallic blade so as to attenuate any component of field that is parallel thereto and not reflected by said metallic blade, in order to provide further decoupling between access ports for respectively accessing the two rectilinear polarized components.

7. Device according to claim 6, wherein said first waveguide is in contact with said first substrate and comprises a recess sized to provide a clearance between said first metallization and said first waveguide, said first waveguide maintained securely in position by means of the tongues of the tube which pass through the slots of said first substrate, said first waveguide fitted within said tongues.

8. Device according to claim 7, comprising:

said second substrate comprising an annular metallization in contact with said second waveguide; and a ground transfer rivet connected to said annular metallization for electrical connection to a groundplane.

9. A device according to claim 8, comprising:

a cup having a short-circuit bottom fitted within the tongues of said tube protruding through said second substrate.

10. A device according to claim 8, comprising:

a third waveguide having diametrically opposed axially extending slots, said third waveguide fitted within tongues of said tube protruding through the slots of said second substrate; and a metallic blade engaged within the axially extending diametrically opposed slots of said third waveguide in order to improve decoupling between the two access ports.

11. Device according to claim 10, wherein said first and second substrates each comprises a laminate including a thin substrate portion and a thick substrate portion which are superimposed, and between which is located a ground plane.

12. Device according to claim 11, wherein said antenna comprises a paraboidal reflector having a focal point at which is positioned a hyperboloidal reflector that returns microwave radiation towards a receiving horn.

* * * * *